US007147121B2

(12) United States Patent
Boucher et al.

(10) Patent No.: US 7,147,121 B2
(45) Date of Patent: Dec. 12, 2006

(54) VALVE FOR NON-SPILL CUP

(75) Inventors: Richard A. Boucher, Ashburnham, MA (US); Craig Stuart Shumway, Oveido, FL (US)

(73) Assignee: ABC Development Inc., Orlando, FL (US)

( * ) Notice: Subject to any disclaimer, the term of this patent is extended or adjusted under 35 U.S.C. 154(b) by 93 days.

(21) Appl. No.: 10/406,744

(22) Filed: Apr. 3, 2003

(65) Prior Publication Data

US 2004/0195253 A1 Oct. 7, 2004

(51) Int. Cl.
*A47G 19/22* (2006.01)

(52) U.S. Cl. ..... 220/203.11; 220/714; 220/717; 215/11.4; 215/11.5; 222/494; 137/843; 137/493

(58) Field of Classification Search ..... 220/711, 220/714, 715, 717, 203.11; 222/482, 490, 222/494; 137/493, 588, 845, 846, 843, 844; 251/335.2; 215/11.4, 11.5, 311, 387; 401/266
See application file for complete search history.

(56) References Cited

U.S. PATENT DOCUMENTS

| | | | | | |
|---|---|---|---|---|---|
| 4,138 | A | | 8/1845 | Pratt | |
| 1,122,868 | A | | 12/1914 | Davis | |
| 1,206,661 | A | | 11/1916 | Booth | |
| 1,593,025 | A | * | 7/1926 | MacDonald | 401/263 |
| 1,825,553 | A | | 9/1931 | Smith | |
| 1,919,859 | A | * | 7/1933 | Phillips | 401/264 |
| 1,989,714 | A | | 2/1935 | Statham | |
| 2,068,213 | A | * | 1/1937 | Wilson | 401/264 |
| 2,174,361 | A | | 9/1939 | Condon | 128/252 |
| 2,175,052 | A | | 10/1939 | Bull et al. | 221/60 |
| 2,223,179 | A | | 11/1940 | Lougheed | 128/252 |
| 2,316,516 | A | * | 4/1943 | Hammerstein | 222/490 |
| 2,417,968 | A | * | 3/1947 | Browne | 137/850 |
| 2,483,750 | A | * | 10/1949 | Bratrud | 30/162 |
| 2,534,614 | A | | 12/1950 | Michael | 65/13 |
| 2,544,464 | A | | 3/1951 | Matthews et al. | 215/11 |
| 2,569,139 | A | | 9/1951 | Abelson | 128/252 |
| 2,608,841 | A | | 9/1952 | Rich | 65/13 |
| 2,623,524 | A | | 12/1952 | Clemens | 128/252 |
| 2,628,616 | A | | 2/1953 | Ransom | 128/252 |

(Continued)

FOREIGN PATENT DOCUMENTS

| | | |
|---|---|---|
| DE | 2 128 875 | 12/1972 |

(Continued)

*Primary Examiner*—Stephen K. Cronin
*Assistant Examiner*—James Smalley
(74) *Attorney, Agent, or Firm*—Davis & Bujold, P.L.L.C.

(57) ABSTRACT

A valve for use with a cap for a spill resistant cup, the cap including a spout to dispense the liquid and a valve mount extending from the spout to engage with the valve. The valve includes a generally cylindrical valve tower extending from a valve base to sealingly engage the valve mount and having an interior bore for the passage of liquid and a valve face sloping across an upper end of the valve tower bore from a higher first point on a first side of the valve tower and to a lower second point on a diametrically opposite second side of the valve tower. A valve mechanism is located in the valve face for controlling a flow of the liquid through the valve mechanism dependent upon a pressure differential across the valve face. The valve mechanism is a valve slit extending through the valve face perpendicular to a mouth opening in the spout and is S-shaped or straight.

17 Claims, 4 Drawing Sheets

U.S. PATENT DOCUMENTS

| | | | | |
|---|---|---|---|---|
| 2,646,670 | A | 7/1953 | Spalding et al. | 65/13 |
| 2,758,755 | A | 8/1956 | Schafler | 222/213 |
| 2,796,062 | A | 6/1957 | Tupper | |
| 2,816,548 | A | 12/1957 | Tupper | |
| 2,989,961 | A | 6/1961 | Blanchett | 128/252 |
| 3,085,710 | A | 4/1963 | McIlroy | 220/90.4 |
| 3,118,468 | A * | 1/1964 | Bochan | 137/846 |
| 3,139,064 | A | 6/1964 | Harle | 116/114 |
| 3,241,726 | A | 3/1966 | Chester | 222/211 |
| 3,342,379 | A | 9/1967 | Foley | 222/173 |
| 3,372,832 | A | 3/1968 | Yeater et al. | 220/29 |
| 3,393,817 | A | 7/1968 | Meierhoefer | 215/11 |
| 3,424,157 | A | 1/1969 | Paolo | 128/252 |
| 3,438,527 | A | 4/1969 | Gamblin, Jr. | 215/1 |
| 3,445,042 | A | 5/1969 | Elmore et al. | 222/212 |
| 3,490,488 | A | 1/1970 | Grist | |
| 3,635,380 | A | 1/1972 | Fitzgerald | 222/484 |
| 3,650,271 | A | 3/1972 | Pelli | 128/252 |
| 3,669,323 | A | 6/1972 | Harker et al. | |
| 3,718,140 | A | 2/1973 | Yamauchi | 128/252 |
| 3,797,696 | A | 3/1974 | Dibrell | 220/90.4 |
| 3,905,512 | A | 9/1975 | Albert et al. | |
| 3,915,331 | A | 10/1975 | Chenault | 220/90.4 |
| 3,921,630 | A | 11/1975 | McPhee | |
| 3,964,631 | A | 6/1976 | Albert | 220/90.4 |
| 4,002,168 | A | 1/1977 | Petterson | |
| 4,057,177 | A | 11/1977 | Laauwe | 222/215 |
| 4,088,166 | A | 5/1978 | Miller | 150/5 |
| 4,133,457 | A | 1/1979 | Klassen | 222/212 |
| 4,135,513 | A | 1/1979 | Arisland | 128/252 |
| 4,138,033 | A | 2/1979 | Payne et al. | 220/254 |
| 4,139,124 | A | 2/1979 | Ferrante | |
| 4,166,553 | A | 9/1979 | Fraterrigo | |
| 4,238,045 | A | 12/1980 | D'Andria | |
| 4,245,752 | A | 1/1981 | Prueher | 220/266 |
| 4,303,170 | A | 12/1981 | Panicci | 220/70 |
| 4,314,658 | A | 2/1982 | Laauwe | 222/213 |
| 4,340,054 | A | 7/1982 | Michaels | 128/260 |
| 4,350,260 | A | 9/1982 | Prueher | 220/254 |
| 4,356,935 | A | 11/1982 | Kamin | 222/1 |
| 4,361,249 | A | 11/1982 | Tuneski et al. | 220/254 |
| 4,434,810 | A | 3/1984 | Atkinson | 137/493 |
| 4,441,623 | A | 4/1984 | Antoniak | 220/90.4 |
| 4,441,624 | A | 4/1984 | Sokolowski | 220/254 |
| 4,463,859 | A | 8/1984 | Greene | 215/11 R |
| 4,470,523 | A | 9/1984 | Spector | 222/181 |
| 4,519,530 | A | 5/1985 | Schmidt | 222/494 |
| 4,582,214 | A | 4/1986 | Dart et al. | 220/90.4 |
| 4,607,755 | A | 8/1986 | Andreozzi | 215/1 A |
| 4,616,768 | A | 10/1986 | Flier | 222/92 |
| 4,646,945 | A | 3/1987 | Steiner et al. | 222/207 |
| 4,660,747 | A | 4/1987 | Borg et al. | 222/213 |
| 4,691,623 | A * | 9/1987 | Mizusawa | 454/164 |
| 4,723,668 | A | 2/1988 | Cheng | 215/11.5 |
| 4,728,006 | A | 3/1988 | Drobish et al. | 222/181 |
| 4,747,519 | A | 5/1988 | Green et al. | 222/181 |
| 4,749,108 | A | 6/1988 | Dornsbusch et al. | 222/212 |
| 4,755,440 | A | 7/1988 | Gartner | 220/90.4 |
| 4,756,440 | A | 7/1988 | Gartner | |
| 4,779,776 | A | 10/1988 | Kinsley | 222/153 |
| 4,782,975 | A | 11/1988 | Coy | |
| 4,795,063 | A | 1/1989 | Sekiguchi et al. | 222/105 |
| 4,796,774 | A | 1/1989 | Nabinger | 220/90.4 |
| 4,828,141 | A | 5/1989 | Coy | |
| 4,836,404 | A | 6/1989 | Coy | |
| 4,865,207 | A | 9/1989 | Joyner et al. | 215/11.5 |
| 4,909,416 | A | 3/1990 | Evezich | 222/95 |
| 4,921,112 | A | 5/1990 | Juhlin et al. | 215/11.4 |
| 4,928,861 | A | 5/1990 | Schiemann | 222/481.5 |
| 4,941,596 | A | 7/1990 | Marty et al. | 222/144.5 |
| 4,941,598 | A | 7/1990 | Lambelet, Jr. et al. | 222/321 |
| 4,946,062 | A | 8/1990 | Coy | |
| 4,953,737 | A | 9/1990 | Meyers | 250/70 |
| 4,987,740 | A | 1/1991 | Coleman | 60/583 |
| 4,991,745 | A | 2/1991 | Brown | |
| 4,993,568 | A | 2/1991 | Morifuji et al. | |
| 5,005,737 | A | 4/1991 | Rohr | 222/212 |
| 5,033,647 | A | 7/1991 | Smith et al. | 222/94 |
| 5,033,655 | A | 7/1991 | Brown | 222/212 |
| 5,035,340 | A | 7/1991 | Timmons | 215/11.4 |
| 5,040,756 | A | 8/1991 | Via Cava | 248/103 |
| 5,050,758 | A | 9/1991 | Freeman et al. | |
| 5,060,811 | A | 10/1991 | Fox | 215/6 |
| 5,071,017 | A | 12/1991 | Stull | 215/260 |
| 5,072,842 | A | 12/1991 | White | |
| 5,079,013 | A | 1/1992 | Belanger | 426/115 |
| 5,101,991 | A | 4/1992 | Morifuji et al. | |
| 5,115,950 | A | 5/1992 | Rohr | 222/490 |
| 5,117,994 | A | 6/1992 | LeBlanc et al. | |
| 5,186,347 | A | 2/1993 | Freeman et al. | |
| 5,203,470 | A | 4/1993 | Brown | |
| 5,213,236 | A | 5/1993 | Brown et al. | 222/185 |
| 5,330,437 | A * | 7/1994 | Durman | 604/167.04 |
| 5,339,995 | A | 8/1994 | Brown et al. | 222/185 |
| 5,377,877 | A | 1/1995 | Brown et al. | 222/105 |
| 5,409,144 | A | 4/1995 | Brown | 222/185 |
| D359,417 | S | 6/1995 | Chen | D7/510 |
| 5,439,143 | A | 8/1995 | Brown et al. | 222/185 |
| 5,542,670 | A * | 8/1996 | Morano | 220/714 |
| 5,706,973 | A * | 1/1998 | Robbins et al. | 220/714 |
| 5,718,691 | A * | 2/1998 | Russo | 604/247 |
| 5,890,621 | A * | 4/1999 | Bachman et al. | 220/717 |
| 6,050,445 | A * | 4/2000 | Manganiello | 220/714 |
| 6,102,245 | A * | 8/2000 | Haberman | 220/714 |
| 6,568,557 | B1 * | 5/2003 | Fusco et al. | 220/714 |
| 6,732,882 | B1 * | 5/2004 | Belcastro | 220/714 |
| 6,745,915 | B1 * | 6/2004 | Rees | 220/714 |
| 6,758,364 | B1 * | 7/2004 | Rohrig | 220/714 |
| 2004/0045922 | A1 * | 3/2004 | Holley, Jr. | 215/11.4 |
| 2004/0099674 | A1 * | 5/2004 | McDonough et al. | 220/714 |

FOREIGN PATENT DOCUMENTS

| | | |
|---|---|---|
| DE | 26 09 310 | 9/1976 |
| DE | 31 18 976 A1 | 12/1982 |
| DE | 39 41 668 A1 | 4/1991 |
| EP | 0 160 336 A2 | 11/1985 |
| EP | 0 278 125 A2 | 8/1988 |
| EP | 0 326 743 A2 | 8/1989 |
| EP | 0 382 631 A1 | 8/1990 |
| EP | 0 384 394 A2 | 8/1990 |
| EP | 0 395 380 A2 | 10/1990 |
| EP | 0 555 623 A1 | 8/1993 |
| FR | 996.998 | 12/1951 |
| FR | 1.364.891 | 10/1964 |
| GB | 1046528 | 10/1966 |
| GB | 1 253 398 | 11/1971 |
| GB | 2 015 350 A | 9/1979 |
| GB | 2 098 958 A | 12/1982 |
| GB | 2 131 301 A | 6/1984 |
| GB | 2 169 210 A | 7/1986 |
| GB | 2 226 014 A | 6/1990 |
| GB | 2 266 045 A | 10/1993 |
| GB | 2 279 130 A | 12/1994 |
| SU | 145824 | 2/1961 |
| WO | WO-93/19718 | 10/1993 |
| WO | WO-94/04023 | 3/1994 |

* cited by examiner

VALVE FOR NON-SPILL CUP

FIELD OF THE INVENTION

The present invention relates to a non-spilling cup for use by, for example, children and other people needing assistance in drinking and, in particular, a non-spill valve for use with a non-spill cup.

BACKGROUND OF THE INVENTION

There have long been various forms of cups and bottles designed to meet the particular specific or specialized drinking needs of various groups of people. For example, the "baby bottle", wherein liquid is drawn through a "nipple" of some form, is designed for use by infants that are just learning to handle and drink liquids and that may not yet be capable of drinking in the more conventional sense, but only of drinking by "sucking". As is well known, drinking by "sucking" requires not only that an infant be able to suck liquid from a bottle, but also that a means be provided to vent air into the bottle so that the infant does not ingest excess air. In addition, the operation of the liquid and air "valve" or "valves" must be passive as infants are not capable of actively operating a valve and, because infants are typically not yet capable of handling a cup or bottle, the bottles must be designed to prevent spills, even when the bottle is dropped or is lying on its side.

Yet another type of bottle or cup are those designed for use by completely capable people that for some exterior reasons, such as being engaged in athletic activity of some form, require a bottle that is spill-proof or spill-resistant, even when shaken, dropped, turn upside down, and so on. Such people are capable of operating a relatively complex spill resistant valve mechanism, and a range of satisfactory designs for such are well known.

There remains, however, a third class of bottles or cups that are intended for persons who are not as limited as infants, but that still require or would benefit from a cup or bottle that provides some assistance in drinking from the cup or bottle. The users of such bottles and cups may include, for example, "toddlers" and other young children past the infant stage, and adults who are handicapped in some manner, such as by age or illness. In such instances, the user will be "drinking" from the cup rather than "sucking", but the requirement that the cup or bottle be spill-proof or spill-resistant when dropped or positioned at a large angle still applies, as does the requirement that any valve or mechanism be simple to use and passive in operation, that is, that it does not require active operation by the user.

Still other requirements are that the spill resistant valve mechanism be simple and inexpensive to manufacture, that the valve provide a smooth and reliable outward flow of liquid and inward flow of air, that the valve allow relatively complete drainage of the cup or bottle, and that the valve be easy to clean. It is also advantageous if the flow of liquid and air by the valve has no abrupt "steps" or "surges", but instead smoothly increases from a relative small starting flow to a large maximum flow, and if the valve does not require excessive "force" or suction to operate.

The present invention provides a solution to these and other related problems of the prior art.

SUMMARY OF THE INVENTION

The present invention is directed to a valve for use with a cap fitted to a spill resistant cup, the cap including a spout to dispense the liquid and a valve mount extending from the spout to engage with the valve.

According to the present invention, the valve includes a generally cylindrical valve tower extending from a valve base to sealingly engage the valve mount and having an interior bore for the passage of liquid and a valve face sloping across an upper end of the valve tower bore from a higher first point on a first side of the valve tower and to a lower second point on a diametrically opposite second side of the valve tower. A valve mechanism is located in the valve face for controlling a flow of the liquid through the valve mechanism dependent upon a pressure differential across the valve face.

In further embodiments of the valve, the valve mechanism is a valve slit extending through the valve face and extending across the valve face from near the first side of the valve tower to near the second side of the valve tower, and the valve slit may be, for example, an S-shaped slit extending across the valve face, or a straight slit extending from near the first side of the valve tower to near the second side of the valve tower and having a small opening at each end of the slit.

Still further according to the present invention, the first side of the valve tower is located adjacent a periphery of the cap and the second side of the valve tower is located inwards of the first side and towards the center of the cap.

According to the present invention, the spout includes a mouth opening extending generally along and adjacent to the periphery of the cap, the first side of the valve tower is located adjacent a periphery of the cap and the second side of the valve tower is located inwards of the first side and towards the center of the cap, so that the valve slit is oriented generally perpendicular to the mouth opening.

According to an embodiment of the present invention, an outer circumferential surface of the valve tower frictionally engages an interior circumferential surface of the valve mount. The valve may further include an outer valve wall extending from the valve base circumferential to the valve tower to form a circumferential recess for receiving the valve mount so that the outer surface of the valve tower and an inner circumferential surface of the outer valve wall frictionally engage the inner surface of the valve mount and an outer circumferential surface of the valve mount.

In a further embodiment of the valve, the cap may include a vent and vent mount spaced apart from the spout for allowing air into the cup and the valve may further include a vent tower spaced apart from the valve tower and sealingly engaging the vent mount and having a bore and a vent face extending across an upper end of the vent tower bore to prevent the passage of one of liquid and air between the vent and the cup through the vent tower.

The embodiments of the valve of the present invention may also include tabs extending from the valve base.

BRIEF DESCRIPTION OF THE DRAWINGS

The invention will now be described, by way of example, with reference to the accompanying drawings in which.

DESCRIPTION OF THE PREFERRED EMBODIMENT(S)

Figure 1:
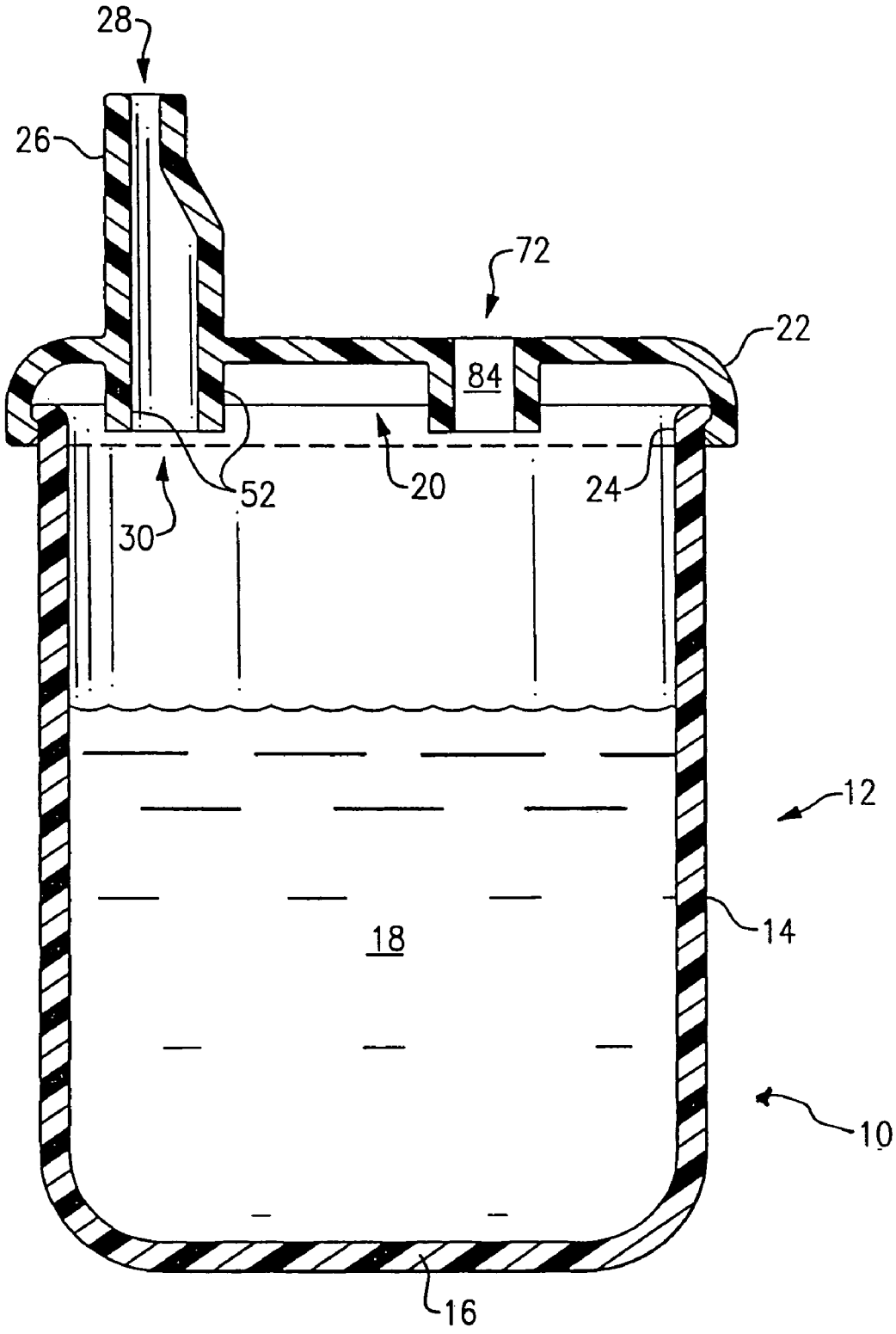
FIG. 1 is a cross section of a cup for use with a valve of the present invention.

Referring to FIG. 1, therein is shown a side sectional view of a typical Cup 10, or bottle, with which the present invention may be implemented. As shown therein, a Cup 10 includes a Body 12 with a Wall 14 and Bottom 16 to contain Liquid 18. The Cup 10 is provided with an Opening 20 at the top of the Cup 10, which is typically closed by a Cap 22 which fits to the Rim 24 of Opening 20 to retain Liquid 18 in the Cup 10.

Cap 22 typically includes an upwardly extending Spout 26 through which Liquid 18 may be drawn by means of a Mouth Opening 28 located at or near the upper part of Spout 26. It should be noted that in this type of cup or bottle, the horizontal cross section of Spout 26 is typically shaped to fit comfortably to a users mouth, that is, is of generally curved oval or elliptical shape. The Mouth Opening 28 is likewise most often of a generally cured oval or elliptical shape, with the horizontal curvature of Spout 26 and Mouth Opening 28 generally following the curvature of Rim 24.

Figure 2:
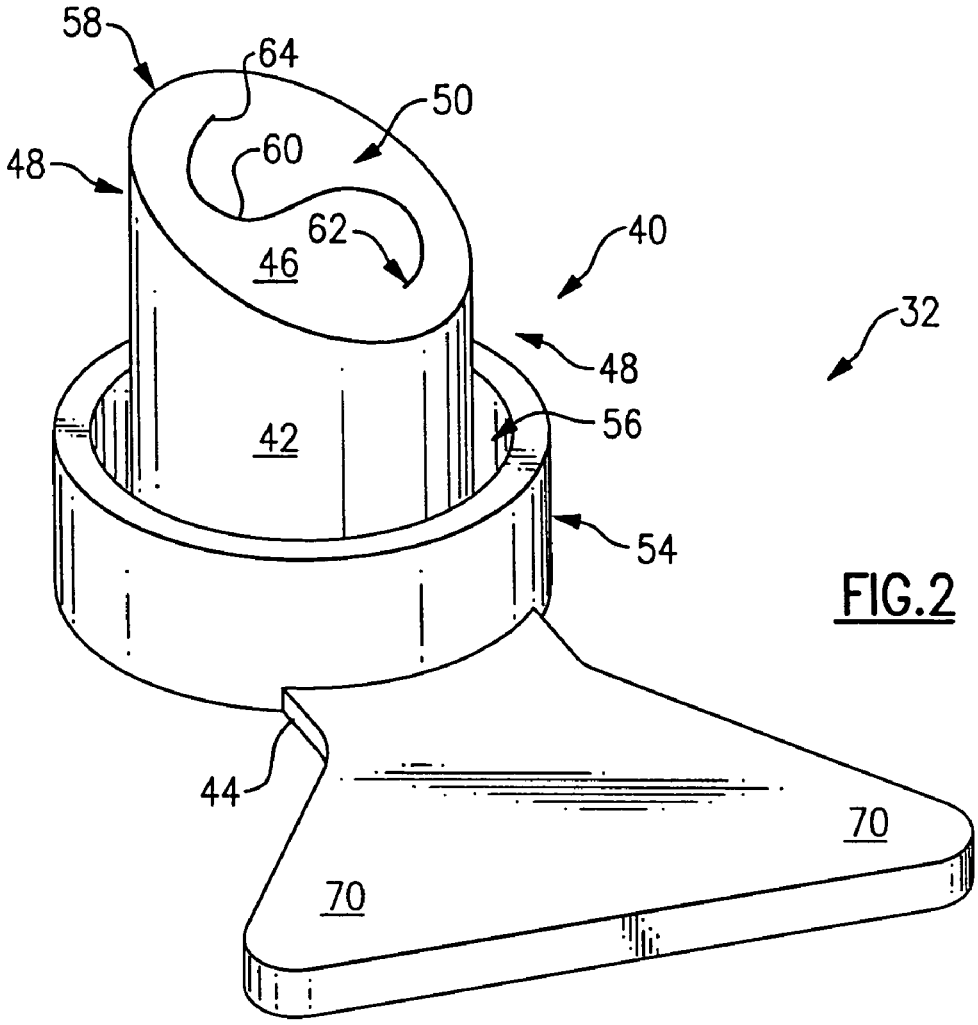
FIG. 2 is a perspective view of a valve.
Figure 3:
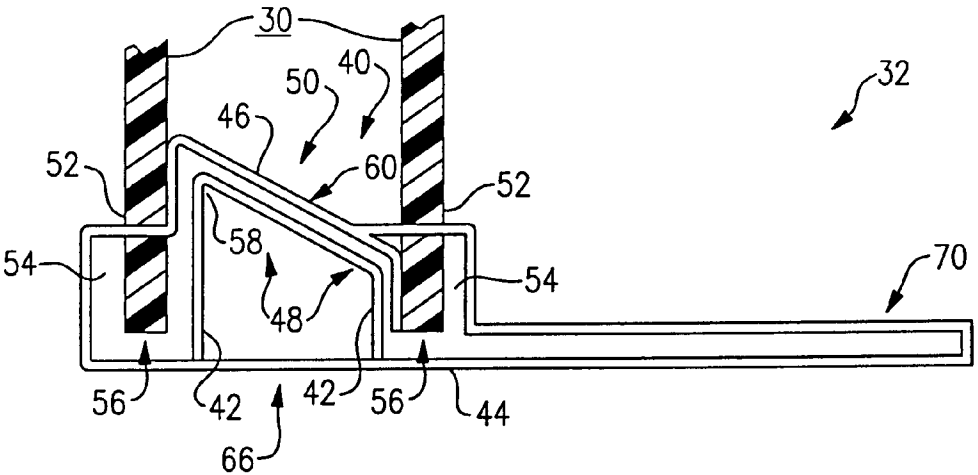
FIG. 3 is a cross sectional view of a valve

The interior of Spout 26 will include a Valve Mount 30 that extends generally downwards from Mouth Opening 28, or the region thereof, and accepts a Valve 32, illustrated in FIGS. 2 and 3, that controls the flow of Liquid 18 from Cup 10 through Spout 26 and Mouth Opening 28. Valve 32 also permits and controls the flow of air into Cup 10 in replacement for Liquid 18.

As illustrated in FIGS. 2 and 3, Valve 32 includes a generally upwardly extending hollow Valve Tower 40 comprised of a generally cylindrical Tower Wall 42 extending upwards from a Valve Base 44 and having a Valve Face 46 which closes the Upper End 48 of Valve Tower 40. As discussed in further detail below, Valve Tower 40 and Valve Face 46 in particular includes a Valve Mechanism 48. Valve Tower 40 extends upwards into Valve Mount 30, wherein the interior surface of a Mount Wall 52 of Valve Mount 30 frictionally engages the generally cylindrical outer surface of Tower Wall 42 of Valve Tower 40, so that Valve Tower 40 is thereby removably retained in Valve Mount 30.

In a present embodiment of Valve Tower 40, Valve 32 is made of Lim(?) silicon having a thickness of approximately 0.80 to 0.1 inch throughout. As shown, Valve Face 46 of Valve Tower 40 is not flat across the diameter of Valve Tower 40, but instead is a sloping plane extending from a maximum height of approximately 0.50 inches above the bottom of Valve Base 44 on one side of Valve Tower 40 to a minimum height of approximately 0.25 inch above the bottom of Valve Base 44 on the diametrically opposite side of Valve Tower 40.

The outer diameter of Tower Wall 42 is approximately 0.6 inch and, in a present embodiment, Tower Wall 42 is surrounded by a concentric Outer Tower Wall 54 extending upwards from Valve Base 44 and having an inner diameter of approximately 0.72 inch. The outer surface of Tower Wall 40, the inner surface of Outer Tower Wall 54 and the upper surface of Valve Base 44 thereby form a circular Mount Recess 56 which excepts the lower portion of Mount Wall 52 generally forming a lower part of Valve Mount 30. In this embodiment, therefore, Tower Wall 42 frictionally engages both the inner and outer surfaces of Mount Wall 52, thereby providing greater security in mounting Valve 32 to Valve Mount 30 and a greater degree of sealing between Valve Mount 30 and Valve 32 and lessening the chance of a liquid or air leak between Valve Mount 30 and Valve 32.

In regard to the above, it must be noted that while Valve Tower 40 is shown as fitting into Valve Mount 30 in the embodiment presently being discussed, the roles of Valve Tower 40 and Valve Mount 30 may be reversed in other implementations. That is, Valve Tower 40 may be adapted to fit "onto" rather than "into" Valve Mount 30. Such adaptations will modifications be readily apparent to those of skill in the arts, however, and will therefore not be discussed further herein.

Referring again to Valve Tower 40 and Valve Mechanism 48, it will be noted that Valve Face 46 slopes radially upwards from a lower point that is located towards the center of Cap 22 and to an upper point that is located towards the circumference of Cap 22. The slope of Valve Face 46 is thereby such that the highest point of Valve Face 46, indicated as Collection Point 58, is the lowest point within Valve Tower 40 when the Cup 10 is positioned for a user to drink from Mouth Opening 28 in Spout 26. That is, in the drinking position Cup 10 will be turned on its side with Mouth Opening 28 and Spout 26 horizontal with respect to Body 12 of Cup 10, or tipped downwards with respect to Body 12. Mouth Opening 28, Spout 26 and Collection Point 58 will then be on or near the bottom periphery of Cap 22 and Liquid 18, or residual amounts of Liquid 18, will therefore tend to collect at Collection Point 58.

As discussed below, Valve Mechanism 48 is of the type generally referred to as a slit valve, wherein a pressure differential between the two faces of the wall or partition containing a slit will result in a flexure of the surface so that edges of the slit separate and allow liquid or air to flow through the slit. The resilience of the material from which the wall or partition is made will then cause the edges of the slit to come together, closing the slit, when the pressure across the wall or partition decreases.

Slit 60 of Valve Mechanism 48 is located in Valve Face 46 such that Slit 60 runs in a generally radial direction with respect to Cap 22, from an Inner End 62 which is towards the center of Cap 22 and to an Outer End 64 which is towards the periphery of Cap 22. Slit 60 is therefore oriented along a line that is generally perpendicular to the line of Mouth Opening 28 in Spout 26 and such that Outer End 64 is located at or near Collection Point 58. The configuration of Valve Face 46 and Slit 60 will thereby combine to assist in collecting and draining any last or residual amounts of Liquid 18 from Valve Tower 40 and thus from Cup 10. That is, the slope of Valve Face 46 will tend to collect Liquid 18 at Collection Point 64 while the orientation of Slit 60 will locate the outer end of Slit 60 near Collection Point 58, thereby reducing the volume in which Liquid 18 can collect. Less Liquid 18 will thereby be left in either Valve 32 or in Cup 10, so that Cup 10 and Valve 32 are cleaner and are easier to clean.

It will also be noted that the wall or partition containing Slit 60, that is, Valve Face 46, extends diagonally across the fluid/air passage, that is, diagonally across the Bore 66 of Valve Tower 40. In the valves of the prior art, however, the wall or partition bearing the valve slit is extends straight across the bore of the fluid/air passage, or is in a hemispherical or dome-like wall or partition. It will therefore be apparent from a consideration and comparison of the basic geometry of Valve Face 46 and Slit 60 of the present invention as opposed to that of previous valves that the use of a sloping or slanted Valve Face 46 allows a significantly greater length of Slit 60 than can be achieved with flat or domed wall or partitions bearing the valve slit. The greater length of Slit 60, in turn, allows a greater flow of fluid or air through Bore 66, allows Slit 60 to open under less pressure differential, and thus to be "easier" to operate. The greater length of Slit 60 further allows Slit 60 and thus Valve 32 to open and close more gradually, thus avoiding or reducing unwanted "surges" of fluid such as may occur with a more conventional valve having a shorter and thus stiffer valve slit that may tend to "snap" open or shut.

In this regard, it should be noted that the easier and more gradual operation of a Valve 32 is no more likely to result in "leaks" when a Cup 10 is horizontal, as when a Cup 10 falls over or is dropped, that is a conventional valve. That is, the pressure differential and absolute pressures along a Slit 60 when a Cup 10 is horizontal are determined by the difference in "depth" from Inner End 62 to Outer End 64. The maximum such "depth" is determined by the diameter of Bore 66 of Valve Tower 40 rather than by the slant length of Valve Face 46 and Slit 60, so that the pressure differential and absolute pressures are no higher than in a valve of the prior art and, consequently, the tendency to leak is no higher.

Figure 4:
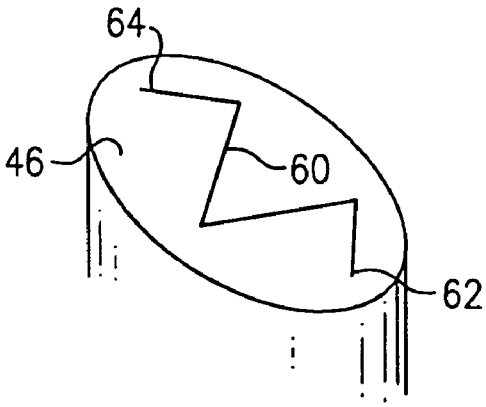
FIG. 4 is an illustration of a valve slit.
Figure 5:
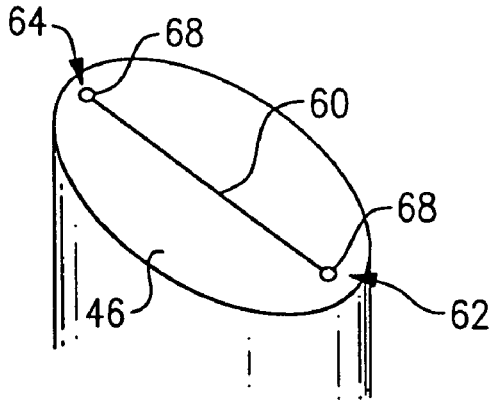
FIG. 5 is an illustration of a valve slit.

Considering Valve 32 and Slit 60 further, Slit 60 is shown in FIGS. 2 and 3 as comprising a doubly curved S-shape. The advantages discussed above with regard to a lengthened Slit 60 in a sloped Valve Face 46 are further extended in this implementation in this embodiment because an S-shaped Slit 60 allows a still longer Slit 60 in the given space, thereby allowing still greater flow or liquid or air and an even more gradual opening and closing operation. These advantages are enhanced still further by the S-shaped Slit 60 as the double curve provides a dual flap-like structure, each "flap" being formed by one section of the double curve, thereby allowing still easier and more gradual opening and closing of the Valve 32. Another and related implementation of Slit 60 is illustrated in FIG. 4, wherein Slit 60 assumes a zig-zag or Z-shape offering many of the same advantages as an S-shaped Slit 60. It will be further appreciated that still other forms of Slit 60 offering additional length beyond the length of Valve Face 46 may be used to similar benefit. Lastly in this regard, yet another embodiment of Slit 60 is illustrated in FIG. 5 wherein Slit 60 assumes the form of a straight, radially oriented line extending across Valve Face 46 from Outer End 64 to Inner End 62 and having a relatively small Slit Holes 68 located at each end of the Slit 60. Slit Holes 68 reduce the possibility that the Slit 60 will rip or tear at the ends over prolonged use and further ease the opening and closing operation of Slit 60. The straight line Slit 60 also offers many of the advantages discussed above, and is somewhat easier in manufacture.

Referring to FIG. 2 and 3, it is shown therein that a Valve 32 may further include one or more Tabs 70 attached to or preferably molded as part of Valve Base 44 to provide a means by which a Valve 32 may be gripped and manipulated. One or more Tabs 70 also increase the dimensions of a Valve 32 to sizes that reduce the "small parts" hazard for children.

Referring to FIG. 1, certain Caps 22 may be provided with a Vent 72 to operate in conjunction with a fluid valve, such as a Valve 32, to allow air to flow into the Cup 10 in replacement for Liquid 18 drained from the Cup 10. In the present invention, it is intended that the operation of a Valve 32 will not require a cooperating Vent 72 as the structure of Valve Mechanism 48 and the shape and orientation of Slit 60 are such that a Valve 32 will function as both a liquid and an air valve, depending upon the direction of pressure differential across the Slit 60. The need for a Valve 32 of the present invention to adapt to the presence of a Vent 72 may occur, for example, when a Valve 32 is intended for use as a replacement for a valve assembly having separate liquid and air valves or when a given Cap 22 is designed to use with more than one type of valve assembly.

Figure 6:
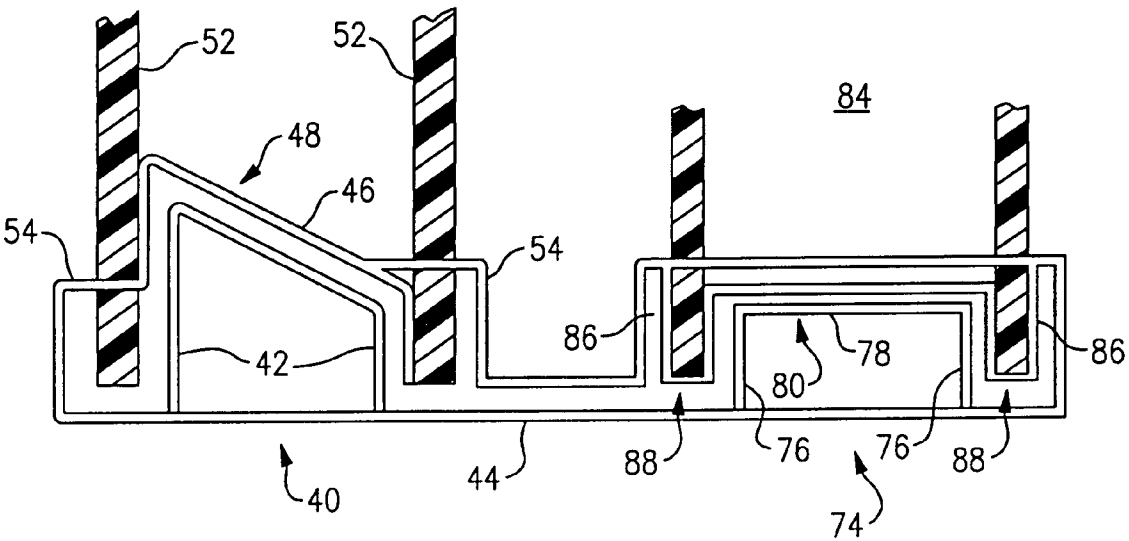
FIG. 6 is a cross section view of a valve with a vent tower.
Figure 7:
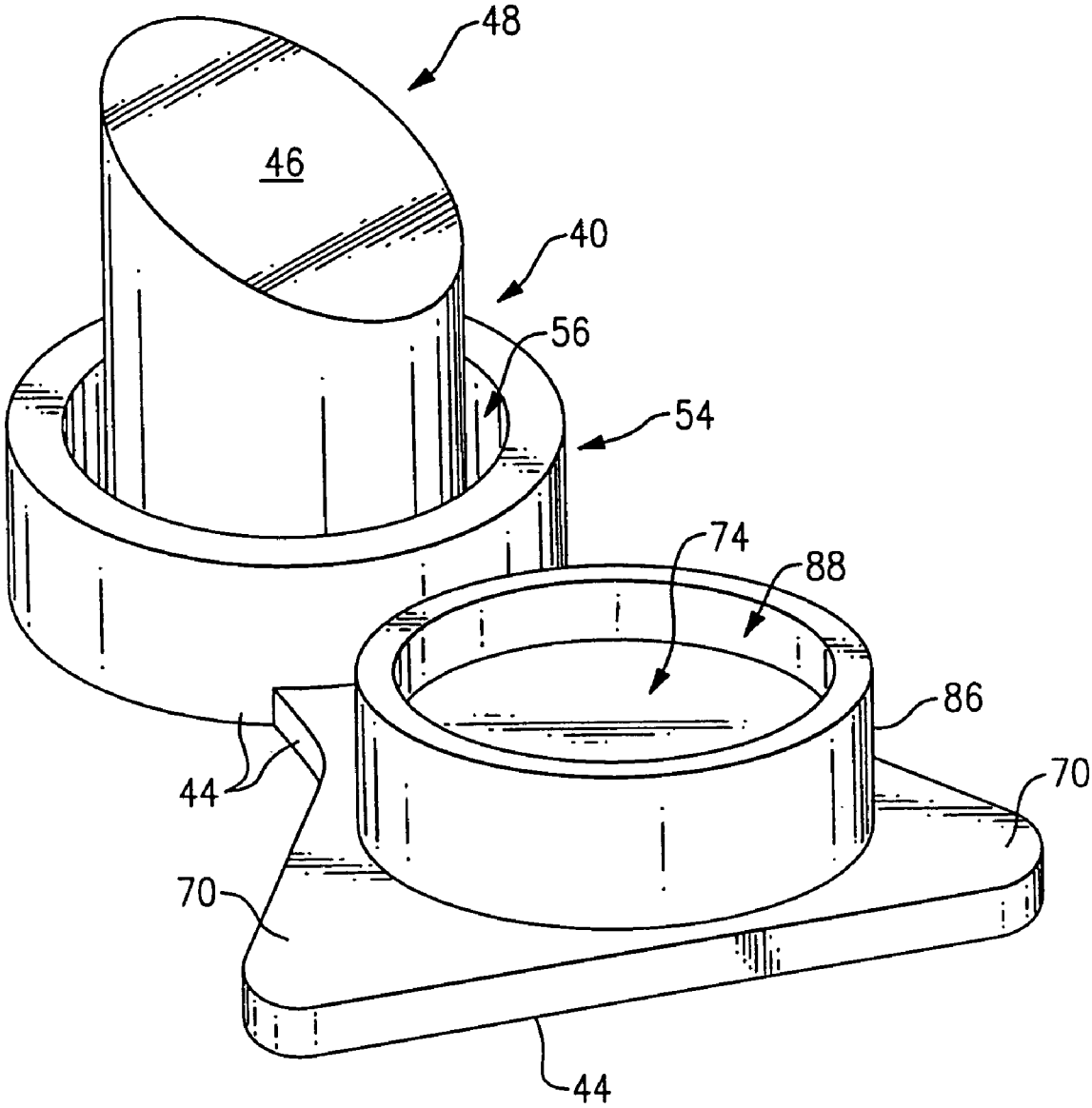
FIG. 7 is a perspective view of a valve with a vent tower.

FIGS. 1, 6 and 7 illustrate an embodiment of a Valve 32 adapted for use with a Cap 22 having both a Spout 26 and a Vent 72. In this implementation of a Valve 32, the Valve Base 44 is extended to support a generally upwardly extending hollow Vent Tower 74 comprised of a generally cylindrical Vent Wall 76 extending upwards from a Valve Base 44 and having a Vent Face 78 which closes the Upper End 80 of Vent Tower 74. Vent Tower 74 typically extends into a Vent Mount 84, which usually extends generally downwards from Vent 72 in Cap 22 to frictionally engage the generally cylindrical outer surface of Vent Wall 76 of Vent Tower 74, so that Vent Tower 74 is thereby removably retained in Vent Mount 84.

As in the instance of Valve Tower 40, Vent Wall 76 is surrounded by a concentric Outer Vent Wall 86 extending upwards from Valve Base 44. The outer surface of Vent Wall 76, the inner surface of Outer Vent Wall 86 and the upper surface of Valve Base 44 thereby form a circular Vent Recess 88 which excepts the lower portion of Vent Mount 84. In this embodiment, therefore, Vent Tower 74 thereby frictionally engages both the inner and outer surfaces of Vent Mount 84, thereby providing greater security in mounting Vent Tower 74 to Vent Mount 84 and a greater degree of sealing between Vent Tower 74 and Vent Mount 84. It will be noted that the roles of Vent Tower 74 and Vent Mount 84 may be reversed, so that Vent Tower 74 fits "onto" Vent Mount 84 rather than "into" Vent Mount 30.

As shown, Vent Tower 74 does not include any form of valve mechanism, and Vent Face 78 is a solid, blank surface sealing Vent Tower 74 from Vent 72 and preventing the passage of both air and liquid between Cup 10 and Vent 72. For this reason, Vent Face 78 may assume any convenient form, and is shown in FIGS. 6 and 7 as being flat. It will be recognized, however, that Vent Face 78 may be of any form that is compatible with and suitable for the specific design of a Vent 72.

Lastly, a Valve 32 of the form illustrated in Fig. may further include one or more Tabs 70 attached to or preferably molded as part of Valve Base 44 to provide a means by which a Valve 32 may be gripped and manipulated. One or more Tabs 70 may also increase the dimensions of a Valve 32 to sizes that reduce the "small parts" hazard for children.

Since certain changes may be made in the above described cup valve without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A valve in combination with a cap fitted to a spill resistant cup to retain liquid in the cup, the cap including a spout to dispense the liquid and a rigid, generally cylindrical and hollow valve mount extending downward from the spout to engage with the valve, the valve comprising:

a cylindrical valve tower having an interior bore for the passage of liquid and extending from a valve base and upward into the interior of the valve mount so that an outer circumferential surface of the valve tower frictionally engages an interior circumferential surface of the valve mount to sealingly engage the valve mount, an outer valve wall, having a height greater than a width of the wall, extending from the valve base circumferential to the valve tower to form a circumferential recess for receiving the valve mount so that the outer surface of the valve tower and an inner circumferential surface of the outer valve wall frictionally engage the inner surface of the valve mount and an outer circumferential surface of the valve mount, an oval valve face sloping across an upper end of the valve tower bore from a higher first point on a first side of the valve tower and to a lower second point on a diametrically opposite second side of the valve tower, and a valve mechanism located in the valve face for controlling a flow of the liquid through the valve mechanism dependent upon a pressure differential across the valve face, including a normally closed valve slit extending through the valve face and extending across the valve face from near the first side of the valve tower to near the second side of the valve tower.

2. The valve of claim 1 wherein the valve slit is an S-shaped slit extending across the valve face.

3. The valve of claim 1 wherein the valve slit is a straight slit extending from near the first side of the valve tower to near the second side of the valve tower and having a small opening at each end of the slit.

4. The valve of claim 1 wherein the first side of the valve tower is located adjacent a periphery of the cap and the second side of the valve tower is located inwards of the first side and towards the center of the cap.

5. The valve of claim 1 wherein the cap further includes a second mount spaced apart from the spout, the valve further comprising:

a second tower spaced apart from the valve tower and the second tower engaging the second mount.

6. The valve of claim 5 wherein the vent tower extends into the interior of the vent mount so that an outer circumferential surface of the vent tower frictionally engages an interior circumferential surface of the vent mount.

7. The valve of claim 1 wherein the valve slit is a straight slit extending from near the first side of the valve tower to near the second side of the valve tower and having a small opening at each end of the slit.

8. The valve of claim 1 wherein the spout includes a mouth opening extending generally along and adjacent to the periphery of the cap, the first side of the valve tower is located adjacent a periphery of the cap and the second side of the valve tower is located inwards of the first side and towards the center of the cap, so that the valve slit is oriented generally perpendicular to the mouth opening.

9. The valve of claim 1 wherein the valve tower extends into the interior of the valve mount so that an outer circumferential surface of the valve tower frictionally engages an interior circumferential surface of the valve mount.

10. The valve of claim 9 wherein the valve further comprises an outer valve wall extending from the valve base circumferential to the valve tower to form a circumferential recess for receiving a leading circumferential edge of the valve mount so that the outer surface of the valve tower and an inner circumferential surface of the outer valve wall frictionally engage the inner surface of the valve mount and an outer circumferential surface of the valve mount.

11. The valve of claim 1, wherein the valve further comprises a tab extending radially away from the valve base to allow the tab to be grasped by a user of the valve.

12. The valve of claim 1 in combination with the cap including the spout and the rigid, generally cylindrical and hollow valve mount, wherein the cap further includes a second mount spaced apart from the spout, the valve further comprising:

a second tower spaced apart from the valve tower and the second tower engaging the second mount.

13. The valve of claim 12 wherein the vent tower extends into the interior of the vent mount so that an outer circumferential surface of the vent tower frictionally engages an interior circumferential surface of the vent mount.

14. The valve of claim 13 wherein the valve further comprises an outer vent wall extending from the valve base circumferential to the vent tower to form a circumferential recess for receiving the vent mount so that the outer surface of the vent tower and an inner circumferential surface of the outer vent wall frictionally engage the inner surface of the vent mount and an outer circumferential surface of the vent mount.

15. The valve of claim 12, further including tabs extending from the valve base.

16. A valve in combination with a cap releasably secured to a spill resistant cup for retaining liquid therein, the cap including a spout to dispense the liquid and a rigid, generally cylindrical and hollow valve mount extending inwardly from the spout and engaging with the valve, the cap further includes a second mount spaced apart from the spout, the valve comprising:

a cylindrical valve tower having an interior bore facilitating passage of liquid and extending from a valve base and outward into an interior of the valve mount such that an outer circumferential surface of the valve tower frictionally engages with an interior circumferential surface of the valve mount to facilitate the valve tower sealingly engaging with the valve mount;

an outer valve wall, having a height greater than a width of the wall, extending from the valve base circumferential about the valve tower and defining a circumferential recess therebetween for receiving the valve mount, and the outer valve wall sealingly engaging an outer circumferential surface of the valve mount and sandwiching a leading circumferential edge of the valve mount therebetween so that the outer surface of the valve tower and an inner circumferential surface of the outer valve wall respectively frictionally engage with an outer circumferential surface of the valve mount and the inner surface of the valve mount;

an inner most end surface of the valve tower having an inclined oval valve face sloping across from a higher first point on a first side of the valve tower and to a lower second point on a diametrically opposite second side of the valve tower; the inclined valve face having a valve mechanism formed therein for controlling a flow of the liquid through the valve mechanism dependent upon a pressure differential across the valve face, and the valve mechanism comprising a normally closed valve slit across the inclined valve face; and a second tower spaced apart from the valve tower and the second tower having a circumferential vent wall which receives and surrounds the second mount.

17. A valve in combination with a cap releasably secured to a spill resistant cup for retaining liquid therein, the cap including a spout to dispense the liquid and a rigid, generally cylindrical and hollow valve mount extending inwardly from the spout and engaging with the valve, the valve comprising:

a cylindrical valve tower having an interior bore facilitating passage of liquid and extending from a valve base and outward into an interior of the valve mount such that an outer circumferential surface of the valve tower frictionally engages with an interior circumferential surface of the valve mount to facilitate the valve tower sealingly engaging with the valve mount;

an outer valve wall, having a height greater than a width of the wall, extending from the valve base circumferential about the valve tower and defining a circumferential recess therebetween for receiving the valve mount, and the outer valve wall sealingly engaging an outer circumferential surface of the valve mount and sandwiching a leading circumferential edge of the valve mount therebetween so that the outer surface of the valve tower and an inner circumferential surface of the outer valve wall respectively frictionally engage with an outer circumferential surface of the valve mount and the inner surface of the valve mount; and an inner most end surface of the valve tower having an inclined oval valve face sloping across from a higher first point on a first side of the valve tower and to a lower second point on a diametrically opposite second side of the valve tower; the inclined valve face having a valve mechanism formed therein for controlling a flow of the liquid through the valve mechanism dependent upon a pressure differential across the valve face, and the valve mechanism comprising a normally closed valve slit across the inclined valve face.

* * * * *